US005667074A

United States Patent [19]

Reali et al.

[11] Patent Number: 5,667,074

[45] Date of Patent: Sep. 16, 1997

[54] MAGNETIC SEPARATOR

[75] Inventors: Angelo Reali, Manhasset Hills; Igor Reznik, Brooklyn, both of N.Y.

[73] Assignee: Crumbrubber Technology Co., Inc., Jamaica, N.Y.

[21] Appl. No.: 518,262

[22] Filed: Aug. 23, 1995

Related U.S. Application Data

[63] Continuation-in-part of Ser. No. 323,538, Oct. 14, 1994, abandoned.

[51] Int. Cl.[6] ..... B03C 1/00

[52] U.S. Cl. ..... 209/224; 209/225; 209/228

[58] Field of Search ..... 209/38, 213, 221, 209/223.1, 223.2, 224–228, 231; 198/619, 670, 678.1, 679

[56] References Cited

U.S. PATENT DOCUMENTS

| | | | |
|---|---|---|---|
| 1,512,344 | 10/1924 | Lorang | 209/224 X |
| 4,498,987 | 2/1985 | Inaba | 209/224 X |
| 4,778,594 | 10/1988 | Doctor | 209/224 |
| 4,784,759 | 11/1988 | Elliott | 209/223.1 |

FOREIGN PATENT DOCUMENTS

| | | | |
|---|---|---|---|
| 108969 | 8/1979 | Japan | 209/224 |
| 1695985 | 12/1991 | U.S.S.R. | 209/224 |

*Primary Examiner*—William E. Terrell
*Assistant Examiner*—Tuan Nguyen
*Attorney, Agent, or Firm*—Collard & Roe, P.C.

[57] ABSTRACT

A magnetic separator having a chamber for receiving material to be separated. The magnetic separator utilizes magnets either along the outer surface of an elongated cylindrical chamber or as the shaft of a helical conveyor. Two outputs are provided for discharging the non-magnetic material and the magnetic material separately from each other.

9 Claims, 4 Drawing Sheets

MAGNETIC SEPARATOR

The application is a continuation-in-part application of U.S. patent application Ser. No. 08/323,538, filed on Oct. 14, 1994, now abandoned.

BACKGROUND OF THE INVENTION

1. Field of the Invention

The present invention relates to separators for recycling. More particularly, it relates to magnetic separation of metal particles from substances, such as, for example, rubber, for further treatment in recycling.

2. The Prior Art

Presently magnetic separation is performed by a number of methods. Among these methods is placing the material to be separated on a conveyor and exposing it to an industrial strength magnet. These type of separators are commonly known as suspended magnetic separators and are manufactured by Eriez Magnetics, in Erie, Pa. Other magnetic separators from Eriez Magnetics employ the use of criss-cross or agitator type magnetic fields to attract the magnetic material, and high speed rotating rare earth magnetic elements within a slowly revolving shell to help achieve the separation.

Another manufacturer, Magni-Power Co. of Wooster Ohio, distributes magnetic pulleys and drums for use in a conveyor type magnetic separator.

SUMMARY OF THE INVENTION

The present invention provides a magnetic separation device for use in recycling and other processes. In the first embodiment of the invention, the magnetic separation device has an elongated cylinder with an input end and an, output end. The input end has an opening in the top of the cylinder for receiving the material to be separated. The output end has two openings disposed on the bottom of the cylinder such that gravity causes the material to fall out of the cylinder when it reaches the output end. The first output opening is a screened opening for discharging the non-magnetic material after the separation is achieved. The second output opening is disposed adjacent the first output opening and discharges the magnetic material from the cylinder after the non-magnetic material has been discharged through the first output opening.

A helical screw is disposed within the elongated cylinder and carries the material to be separated from the input end to the output end of the elongated cylinder. A motor is connected to the helical screw through one of the ends of the elongated cylinder. The motor adjustably rotates the helical screw and thereby adjustably controls the flow of material through the cylinder.

A magnet is symmetrically disposed along the top of the cylinder and extends from the input end to a point where the first output opening ends and before the second output opening begins. The magnet attracts the magnetic particles within the material to be separated toward the top of the cylinder and maintains the separation while the material is carried and rotated through the cylinder by the helical screw. Once the non-magnetic material is discharged through the first output opening, the magnet ends and the separated magnetic material falls through the second output opening.

In a second embodiment of the invention, a plurality of helical conveyors are provided within a housing. The housing has an input opening at the top for receiving the material to be separated and two output openings for discharging the magnetic material and non-magnetic material separately. The housing is further separated into two compartments.

The helical conveyors have a shaft portion and a conveyor portion wrapped around the shaft portion. The shaft portion extends the entire length of the housing in horizontal position relative thereto. The shafts include a magnetic portion and a non-magnetic portion for enabling the separation of magnetic material. The shaft portion of the conveyors does not rotate, while the outer helical portion rotates around the shaft portion.

The first of the two compartments of the housing encloses the magnetic portion of the shaft, while the other of the two compartments encloses the non-magnetic portion of the shaft.

It is therefore an object of the present invention to provide a magnetic material separator that operates effectively and reliably by exposing the material to be separated in a contained magnetic field and discharging the non-magnetic material before removing the magnetic field.

It is yet another object of the invention to provide a magnetic material separator that is simple in design, easy to manufacture and reliable in operation.

Another object of the invention is to provide a magnetic material separator for use in recycling processes that can adjustably control the output of separated materials.

Yet another object of the invention is to provide a magnetic material separator for use in recycling processes that is a self contained device.

BRIEF DESCRIPTION OF THE DRAWINGS

Other objects and features of the present invention will become apparent from the following detailed description considered in connection with the accompanying drawing which disclose an embodiment of the present invention. It should be understood, however, that the drawing is designed for the purpose of illustration only and not as a definition of the limits of the invention.

In the drawing, wherein similar reference characters denote similar elements throughout the several views:

FIG. 5 taken along line VI—VI;

DETAILED DESCRIPTION OF PREFERRED EMBODIMENTS

Figure 1:
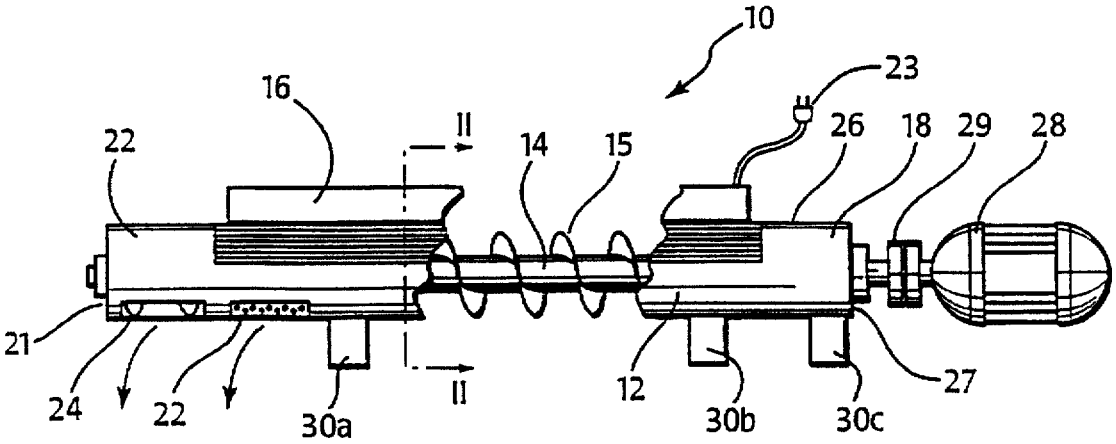
FIG. 1 is a side view, in partial cross-section, of the magnetic separator of the invention.

Turning now in detail to the drawings, FIG. 1 shows the magnetic separator 10 having an elongated cylinder 12 with helical screw 14 disposed longitudinally therein. Cylinder 12 has an input end 18 with an input opening 26 for receiving the material to be separated and a first flange 27 enclosing said cylinder. Input opening 26 is disposed on the top of cylinder 12 at input end 18 and is simply an opening in cylinder 12.

A distal output end 20 is spaced from input end 18 on cylinder 12. Output end 20 has a second flange 21 enclosing cylinder 12, a first output opening 22 and a second output opening 24 disposed on the bottom of cylinder 12 such that gravity aids in discharging the separated material from cylinder 12. First opening 22 is for discharging the non-magnetic material from cylinder 12 after separation has been performed. First opening 22 can have a screen 23 for preventing large particles from passing therethrough. The screen 23 can be a screen of any suitable known type and size according to the material being separated. Second output opening 24 is disposed adjacent second flange 21 and between said end plate and first output opening 22. Second output opening 24 is for discharging the magnetic material separated from the non-magnetic material.

A magnet 16 is disposed along the top of cylinder 12 and extends from input opening 26 to output end 20. In the preferred embodiment of the invention, magnet 16 extends along the top of cylinder 21 from input opening 26 to a point at output end 20 after first output opening 22 and before second output opening 24. Thus, when material is carried through separator 10 by helical screw 14, magnet 16 attracts the magnetic particles toward the top of cylinder 12 and allows the non-magnetic material to be discharged through first output opening 22. After the material has been discharged through first output opening 22, magnet 16 ends, and the separated magnetic material is no longer attracted to the top of cylinder 12 and is subsequently carried by screw 14 to the second output opening 24 where it is discharged.

The cylinder 12 and helical screw 14 are made of any suitable known metal having magnetic properties when exposed to magnetic fields, and that does not retain those magnetic properties when the magnetic field is removed. An example of such a material may be aluminum, Alnico alloys, and steel. Helical screw 14 has threads 15 which receive and carry the material to be separated through elongated cylinder 12. Helical screw 14 with threads 15, has a diameter slightly smaller than the diameter of cylinder 12 such that screw 14 can rotate freely within cylinder 12.

In the preferred embodiment of the invention, cylinder 12 has a longitudinal axis that is maintained in a substantially horizontal position during operation. However, the magnetic separator 10 can be operated at various angles apart from the standard horizontal position. For example, in a second embodiment, output end 20 may raised to a substantially vertical position such that the input end 18 is lower than output end 20. In this configuration, the separator 10 would push the material against the force of gravity while separating the magnetic material therefrom.

In another embodiment, the input end 18 could be raised above the horizontal position such that cylinder 12 is at an angle with the ground, up to a potential vertical 90 degrees position. In this position, the forces of gravity will aid helical screw 14 in carrying the material downward through cylinder 12.

Leg supports 30*a*, 30*b* and 30*c* are used to support the magnetic separator during use. Any other suitable known type of support device will suffice for providing the needed support during operation.

Motor 28 is connected to helical screw 14 through input end plate 27 of cylinder 12 by bearing connection 29. Motor 28 is a variable speed motor and adjustably rotates helical screw 14 according to the desired speed. Motor 28 is variable in a range of 3–20 revolutions per minute. Any other suitable known type of variable speed motor can be employed to rotate helical screw 14.

Figure 2:
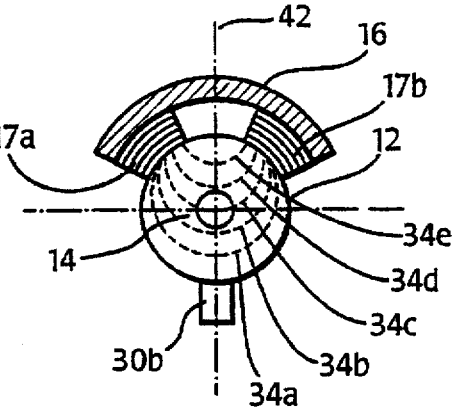
FIG. 2 is a cross-sectional view of the magnetic separator taken along line II—II of FIG. 1.

FIG. 2 shows a cross-section of cylinder 12 with a diametrical horizontal axis line 40 and a diametrical vertical axis line 42. The magnet 16 is symmetrically disposed on the top of cylinder 12 about diametrical vertical axis line 42. Magnet 16 is comprised of two elongated magnet portions 17*a* and 17*b* which extend along the outer surface of cylinder 12. The magnetic field lines 34*a*–34*e* show the attraction of the magnetic particles within cylinder 12 toward the top thereof. The magnet 16 is preferably an electromagnet, however, any magnet of suitable known type will function the same. A power line 23 (FIG. 1) shows the configuration with an electromagnet disposed on cylinder 12.

Figure 3:
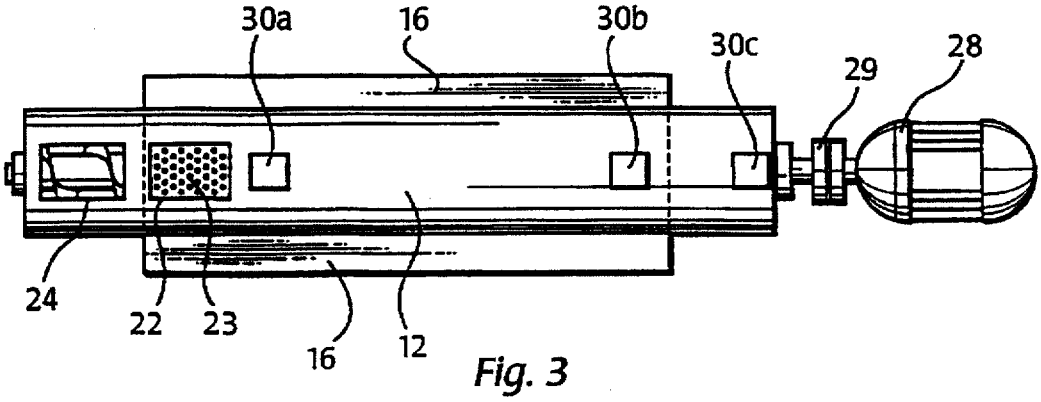
FIG. 3 is a bottom view of the magnetic separator of the invention.

FIG. 3 shows the bottom of cylinder 12 in the preferred embodiment with the first output opening 22 disposed under magnet 16 while second output opening 24 is disposed adjacent end 21 and opening 22, but without magnet 16 disposed thereabove. Thus, when the material to be separated is fed into the separator at the input end, helical screw 14 carries and rotates the material within the separator. During the rotation and movement of the material, the magnetic material is attracted by the internal magnetic field created by the external magnet and is thereby drawn to the top of the of the separator cylinder. When the material has been carried and rotated to the output end 20, the non-magnetic material is discharged through first output opening 22. After the non-magnetic material is discharged through opening 22, the remaining magnetic material is carried to the second output opening 24 where it is discharged from the separator. Since magnet 16 ends at a point between the first output opening 22 and the second output opening 24, when the magnetic material is carried beyond opening 22, it is no longer attracted by magnet 16 and is thereby discharged through output opening 24 by helical screw 14 and the forces of gravity. In another embodiment of the invention (not shown), magnet 16 can extend over output opening 24. This will cause screw 14 to force the separated magnetic material from the cylinder 12 without the aid of gravity.

Figure 4:
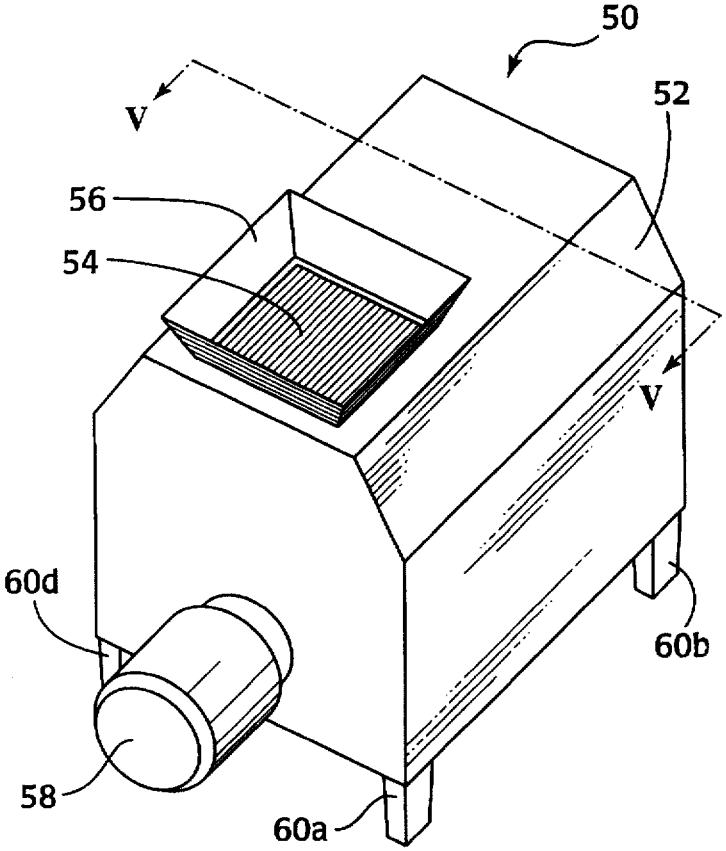
FIG. 4 is a top view of a second embodiment of the magnetic separator according to the invention.
Figure 5:
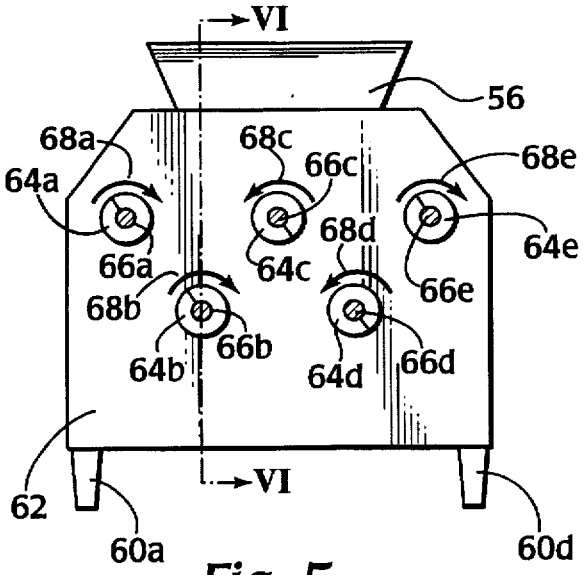
FIG. 5 is a cross section of the magnetic separator of FIG. 4 taken along line V—V.

FIGS. 4–7 shows a second embodiment of the magnetic separation apparatus according to the invention. FIG. 4 shows the magnetic separator 50 having a housing 52 with an input opening 54 disposed on the top of said housing. Legs 60*a*–*d* elevate and support housing 52. Legs 60*a*–*d* can be adjustable or fixed in height. In another embodiment, not shown, housing 52 can be suspended from the ground by any suitable know type of suspension means. An input shield 56 is provided around input opening 54 to aid in the input of material to be separated into magnetic separator 50. Input shield 56 is angled so as to increase the receiving area of input opening 54. A variable speed motor 58 is connected to one end of housing 52 and provides the required rotational movement of helical conveyors 64*a*–*e* (FIG. 5).

FIG. 5 shows a cross-section of the magnetic separator 50 taken along line V—V of FIG. 4. A plurality of helical conveyors 64*a*–*e* are mounted within housing 52 in spaced relation with respect to each other and substantially parallel to each other. Each helical conveyor 64*a*–64*e* has a corresponding fixed shaft portion 66*a*–66*e* and 70*a*–70*e*, respectively, and a specific rotational direction 68*a*–68*e*. The rotational direction of each helical conveyor 64*a*–64*e* rotates in a direction opposite with respect to the next adjacent conveyor. Helical conveyors 64*a*–64*e* are made of any suitable non-magnetic material such as, for example, stainless steel.

Figure 6:
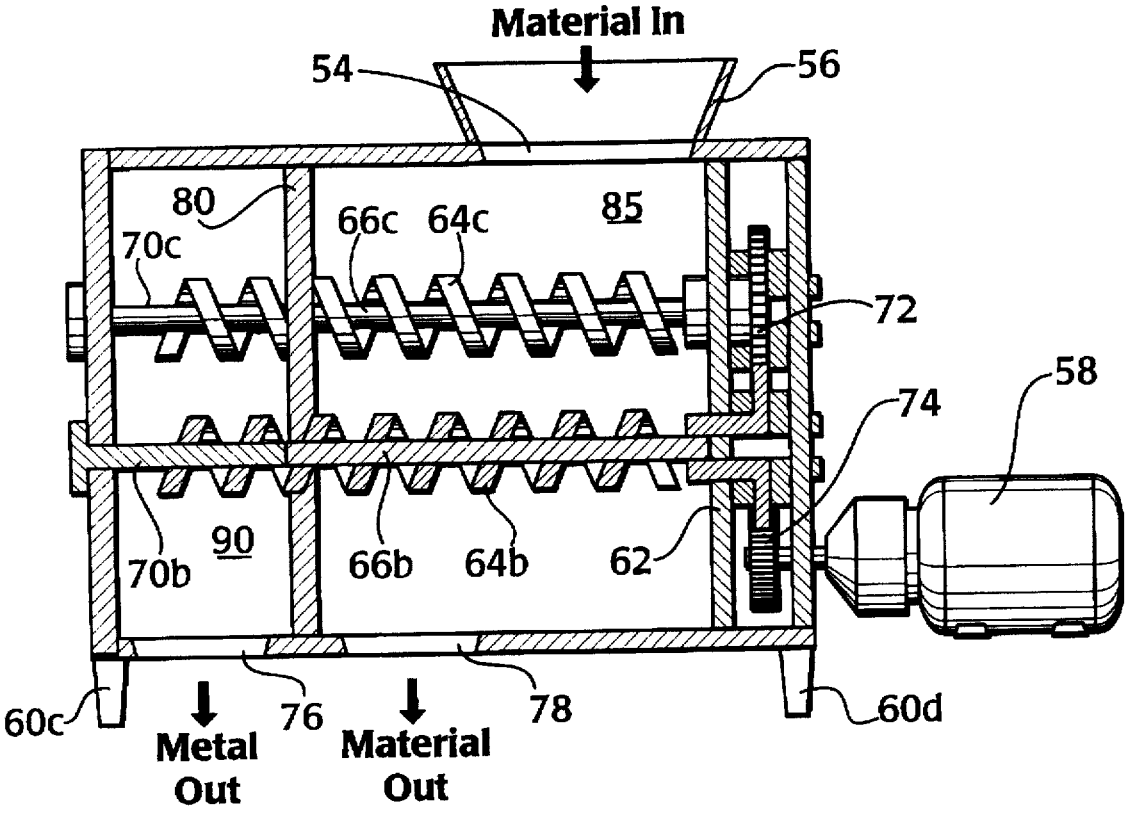
FIG. 6 is a cross section of the magnetic separator

FIG. 6 shows a cross-section of the magnetic separator taken along line VI—VI of FIG. 5. Housing 52 is internally separated into two compartments 85 and 90 by a partition wall 80. The first compartment 85 receives the material to be separated through input opening 54 where it is then carried by helical conveyors 64*a*–64*e* into the second compartment 90. The shaft portions of helical conveyors 64*a*–*e* have a first section 66*a*–*e* and a second section 70*a*–*e*. (66*c*, 70*c*, 66*b* and 70*b* shown) The first section 66*c* is contained within first compartment 85 and the second section 70*c* is contained within second compartment 90.

The first shaft sections 66*a*–*e* consist of an exposed magnet, while the second shaft sections 70*a*–*e* consist of any other non-magnetic material, such as, for example, stainless steel. The first shaft sections can be any natural magnetic substance, or can be an electro-magnet. Shaft portions 66*a*–*e* and 70*a*–*e* are stationary during operation. Thus, helical conveyors 64*a*–64*e* are rotated, through a gearing mechanism 72, around both of the magnetic and non-magnetic shaft portions to carry the material to be separated through the magnetic separator. Motor 58 is connected to gearing system 72 through gear 74. The gearing mechanism 72 is enclosed in housing 52 and separated from compartment 85 by a partition wall 62.

Figure 7:
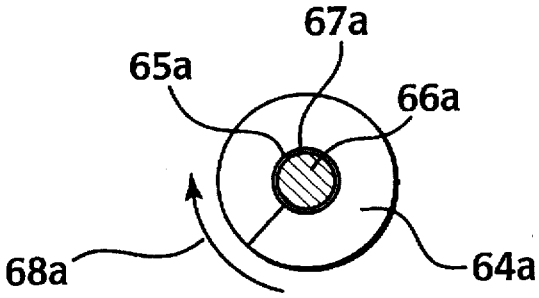
FIG. 7 is a cross section of a helical conveyor according to the second embodiment of the invention.

FIG. 7 shows an enlarged view of helical conveyor 64*a*. As shown, helical conveyor 64a rotates in a direction 68*a* around shaft 66*a*. Shaft 66*a* is an exposed magnet of any suitable known type. Helical conveyor 64*a* has an inside surface 65*a* that is situated adjacent the exterior surface 67*a* of shaft 66*a*, such that the rotation of helical conveyor 64*a* enables said conveyor to move material along shaft 66*a* without interfering with the attraction of magnetic particles to shaft 66*a*. In another embodiment of the invention, the magnetic shaft 66*a* can be rotated in a direction 69 opposite to the rotational direction 68*a* of helical conveyor 64*a* or in the alternative, in the same direction 68*a* as said conveyor. When magnetic shaft 66*a* is rotated in the same direction 68*a* as helical conveyor 64*a*, it is preferable to rotate said magnetic shaft at variable different speeds with respect to said helical conveyor.

Thus, when material to be separated is input through input opening 54, the material is placed in direct contact with a plurality of helical conveyors 64*a*–*e* and the magnetic shafts 66*a*–*e* associated therewith. As helical conveyors 64*a*–e are rotated in their respective directions 68*a*–68*e*, the magnetic material is attracted to the exposed magnetic shafts 66*a*–66*e* and the non-magnetic material is discharged through a first output opening 78. This discharge of non-magnetic material is aided by gravity.

As the non-magnetic material is discharged through output opening 78, the magnetic material continues to be carried along the magnetic shafts 66*a*–*e* into the second compartment 90 of separator 50. Once the magnetic material passes along shafts 66*a*–*e* beyond partition wall 80, and into compartment 90, said shafts become non-magnetic (70*a*–70*e*) and the magnetic material is released from said shafts and discharged from a second output opening 76.

Figure 8:
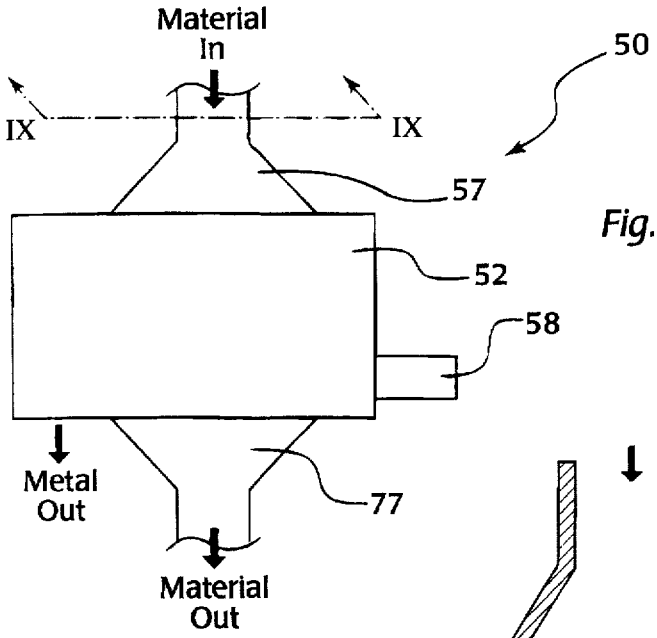
FIG. 8 is an elevational view of a third embodiment of the magnetic separator according to the invention.

FIG. 8 shows a third embodiment of the magnetic separator 50 disposed in-line with the material input receiver 57 and material output duct 77. The housing 52 of separator 50 is suspended within a conveyor system such that unseparated material is fed into input receiver 57, separated within said housing, and the non-magnetic material is discharged through output duct 77 for further processing. The magnetic material is then discharged through output opening 76 (FIG. 9).

Figure 9:
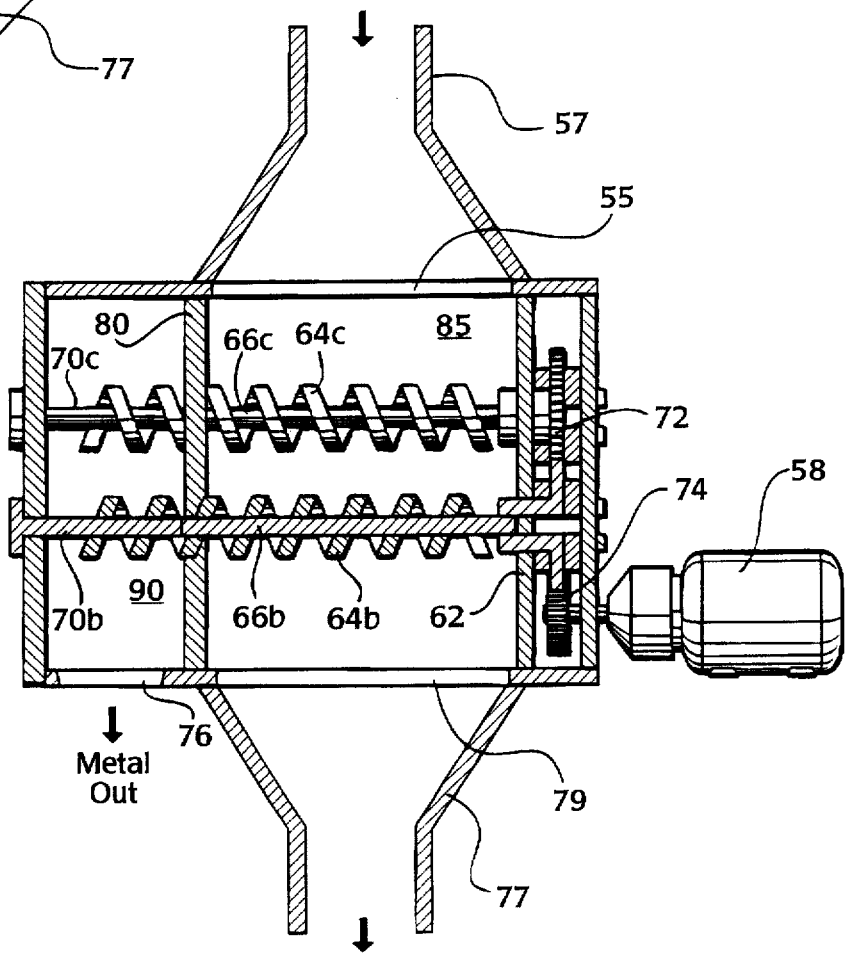
FIG. 9 is a cross-sectional view of the magnetic separator of FIG. 8 taken along line IX—IX.

FIG. 9 shows a cross sectional view of the embodiment of FIG. 8 taken along line IX—IX. Housing 52 has an input opening 55 in the top thereof and completely enclosed by input receiver 57. Output opening 79 is disposed in the bottom of the magnetic separator housing, and in also completely enclosed by output duct 77. The operation of magnetic separator 50 is the same as described for FIGS. 4–7.

While three embodiments of the present invention has been shown and described, it is to be understood that many changes and modifications may be made thereunto without departing from the spirit and scope of the invention as defined in the appended claims.

What is claimed is:

1. An apparatus for separating material having magnetic properties from non-magnetic material comprising:

an elongated cylinder having a longitudinal axis centrally disposed therein, and including an outer surface, an input end and a distal output end, said distal output end comprising a second flange enclosing said cylinder at its output end, and first and second output openings disposed adjacent said distal output end of said elongated cylinder, said first output opening for discharging the non-magnetic material, said second output opening for discharging the separated magnetic material, and wherein the axis of said cylinder is disposed in a non-vertical orientation, said first and second output openings being axially adjacent to each other such that said second output opening is disposed between said first output opening and said second flange of said cylinder;

carrier means disposed within said cylinder for carrying the material from said input end to said output end, said carrier means comprising a helical screw extending from the input end to the output end of said elongated cylinder;

power means connected to said carrier means through one of said ends of said cylinder for driving said carrier means; and magnetic separating means disposed on said cylinder for separating the material having magnetic properties from the material having non-magnetic properties.

2. The apparatus according to claim 1, wherein said input end comprises a first flange enclosing said input end of said cylinder, and an input opening in said elongated cylinder for receiving the material to be separated.

3. The apparatus according to claim 2, wherein said magnetic separating means comprises an elongated magnet means disposed on the outer surface of said elongated cylinder and extending substantially from said input end to said second output opening.

4. The apparatus according to claim 3, wherein said elongated magnet means comprises two elongated spaced apart magnets disposed along the outer surface of said cylinder.

5. The apparatus according to claim 4, wherein said magnets are electromagnets.

6. The apparatus according to claim 2, wherein said power means comprises a variable speed motor connected to said helical screw for rotating said screw at a preselected speed.

7. An apparatus for separating material having magnetic properties from non-magnetic material comprising:

an elongated cylinder having an outer surface, an input end, a distal output end, a longitudinal axis centrally disposed within said cylinder, an upper portion above said axis and a lower portion below said axis, said input end comprising a first flange enclosing said input end of said cylinder and an input opening in said upper portion of said elongated cylinder for receiving the material to be separated, said distal output end comprising a second flange enclosing said cylinder at said output end, and first and second output openings in said lower portion of said elongated cylinder, said first output opening for discharging the non-magnetic material, said second output opening for discharging the separated magnetic material, said first and second output openings being adjacent to each other such that said second output opening is disposed between said first output opening and said second flange of said cylinder;

carrier means disposed in said cylinder for carrying the material from said input end to said output end, said carrier means comprising a helical screw extending from said input end to said output end of said elongated cylinder;

a variable speed motor connected to said carrier means through one of said ends of said cylinder for adjustably rotating said carrier means; and magnetic separating means disposed on said outer surface of said cylinder for separating the material having magnetic properties from the non-magnetic material.

8. The apparatus according to claim 7, wherein said magnetic separating means comprises an elongated magnet means disposed on said outer surface along said upper portion of said elongated cylinder and extending from said input end to said second output opening, said magnet being symmetrically disposed on said outer surface of said cylinder.

9. The apparatus according to claim 8, wherein said magnet means is an electromagnet.

* * * * *